US005901795A

United States Patent [19]

Tsao et al.

[11] Patent Number: 5,901,795

[45] Date of Patent: May 11, 1999

[54] WELL COLLISION AVOIDANCE

[75] Inventors: Yuh-Hwang Tsao; Charles R. Dawson, both of Houston, Tex.; David W. Ure, Beaumaris, Victoria, Australia

[73] Assignee: Exxon Production Research Company, Houston, Tex.

[21] Appl. No.: 08/880,614

[22] Filed: Jun. 23, 1997

Related U.S. Application Data

[60] Provisional application No. 60/020,411, Jun. 25, 1996.

[51] Int. Cl.[6] ..... E21B 47/00

[52] U.S. Cl. ..... 175/45; 702/9

[58] Field of Search ..... 175/40, 45, 135, 175/220, 424; 702/6, 9

[56] References Cited

U.S. PATENT DOCUMENTS

| | | | |
|---|---|---|---|
| 4,303,975 | 12/1981 | Hepp | 364/422 |
| 4,453,219 | 6/1984 | Clavier et al. | 364/422 |
| 4,957,172 | 9/1990 | Patton et al. | 175/61 |
| 5,103,920 | 4/1992 | Patton | 174/45 |
| 5,467,821 | 11/1995 | Sieber | 166/123 |
| 5,475,589 | 12/1995 | Armitage | 364/421 |

OTHER PUBLICATIONS

"Quantative Risk Assessment of Subsurface Well Collisions," J.L. Thorogood, F.G. Tourney, F.K. Crawley, and G. Woo, SPE 20908, (pp 265–272) Oct. 1990.

"Application of Risk Analysis Methods to Subsurface Well Collisions," J.L. Thorogood, T.W. Hogg, and H.S. Williamson SPE Drilling Engineering, (pp 299–304) Dec. 1991.

*Primary Examiner*—Roger Schoeppel
*Attorney, Agent, or Firm*—Marcy M. Lyles

[57] ABSTRACT

A novel method of determining the probability that a planned drilling path will collide with an existing wellbore is disclosed. The method utilizes available uncertainty information to determine a probability for each of a plurality of segments of the planned drilling path that a projection of the segment onto a plane will intersect a projection of a corresponding segment of the existing wellbore onto the plane. The method of this invention then determines the net probability for each segment of the planned drilling path that the segment will intersect the corresponding segment of the existing wellbore by taking into account the effect of constraints imposed on each segment, by adjacent segments. The probability that the planned drilling path will intersect the existing wellbore is determined by adding together all of the net probabilities.

4 Claims, 4 Drawing Sheets

WELL COLLISION AVOIDANCE

This application claims the benefit of U.S. Provisional Application No. 60/020,411 filed Jun. 25, 1996.

FIELD OF THE INVENTION

When drilling from an offshore oil/gas platform, multiple wells often must be drilled in a limited space. In this situation, the potential for a new well being drilled to collide with an existing well can be high. Well collisions can lead to potentially serious problems, such as well blowouts. The safety and environmental risks associated with well blowouts are well known in the oil industry. This invention relates to a method for reducing the likelihood of well collisions.

BACKGROUND

When preparing to drill a new well, the surveyed locations of any nearby wells are considered. As with most measurements, the survey measurements involve inaccuracies (survey uncertainty). While the new well is being drilled, the drill bit may not follow the planned path (drilling uncertainty). The potential for well collisions to occur is affected by survey uncertainty, the distance or interval between surveys (survey interval), drilling uncertainty, distance and intersection angle between the wells, and well diameter.

In view of survey uncertainty and drilling uncertainty, industry practice has been to design the path of a new well to be kept apart from any existing well at greater than a specified minimum distance in order to avoid well collisions. If, for economic or other reasons, the new well must be drilled closer to an existing well than this minimum distance, preventive actions, e.g., plugging the existing well, are taken to reduce the consequences of potential problems caused by well collision. Traditionally, this minimum distance is derived from experience and intuition, as a function of depth. While the traditional approach can be used to avoid well collisions, the approach does not always include rigorous risk assessments. This can lead to overly risky, and potentially dangerous, or overly conservative, and costly, drilling.

A better approach to avoid well collision problems is to mathematically assess the risk of well collision and the likelihood that a collision will result in a problem, and to develop appropriate action plans according to the assessed risk. For a problem to result from a well collision, wells have first to collide ("well collision probability") and then the collision has to lead to that problem ("event chain probability"). The probability for a well-collision related problem to occur is the product of the well collision probability and the event chain probability. The event chain probability depends on local conditions and may be determined by using conventional probability analysis techniques, such as event tree analysis, which are well known to those familiar with quantitative risk assessment (QRA). QRA is the development of a quantitative estimate of risk based on engineering evaluation and mathematical techniques. A primary challenge in developing QRA for well collision is to know how to estimate collision probability.

The need for a reliable method to estimate well collision probability has received attention from the upstream petroleum industry in recent years. In two papers published in 1990 and 1991, equations were proposed for straight holes (or portions of wells), and separate models for parallel and non-parallel holes were provided. (Thorogood, J. L., et. al: "Quantitative Risk Assessment of Subsurface Well Collisions," SPE Paper 20908, 1990; and Thorogood, J. L., Hogg, T. W. and Williamson, H. S. "Application of Risk Analysis Methods to Subsurface Well Collision," SPE Drilling Engineering, December 1991.) The model proposed in the papers for parallel wells is a two-dimensional (2-D) solution. While the papers indicate recognition of the need for a three-dimensional (3-D) solution for non-parallel wells and consider the effect of intersection angle between two wells, the papers do not propose a 3-D solution. The equations in the published papers appear to have the following shortcomings: (i) the calculated probability based on the equations can be much larger than 1.0 or 100%; (ii) the collision probability for non-parallel wells does not approach parallel wells when intersection angle approaches zero; and (iii) probability always decreases with increasing intersection angle, even for a short well segment.

Related U.S. Pat. Nos. 4,957,172 and 5,103,920 describe a system and method for drilling a second wellbore along a planned path with respect to a first wellbore. The patents are directed toward a method of drilling a relief well to intersect a blowout well at a target location in the blowout well for the purpose of relieving fluid pressure in the blowout well. The bases of the patents are maintaining high probabilities of find and of intercept, i.e., high probabilities that the blowout well can be located using a search tool in the borehole of the relief well and that the borehole of the relief well will intercept the blowout well at the target location, while maintaining a low probability of collision, i.e., a low probability that the borehole of the relief well will collide with the blowout well before the target location or that the borehole of the relief well will collide with another nearby well. The patents discuss use of a probable location distribution (PLD) and a relative probable location distribution (RPLD) for describing the locations of the borehole and the blowout well. The PLD is a quantitative description of where the well is located in statistical terms. The RPLD is a tri-axial location error distribution which includes the surface site errors and the systematic and random errors due to directional surveys of both the blowout and relief wells. The method of these patents uses probability equations based on errors in surveying but does not take into consideration other useful factors such as distance and intersection angle between the wells and well diameter.

Other work in this area has only marginally succeeded in developing a solution, albeit a 2-D solution, for calculating collision probability of two straight and parallel wells, a rare and unrealistic case. A common method to expand a 2-D solution for a 3-D problem is to sum or integrate the 2-D solution of many thin parallel slices of the 3-D space. This method has worked successfully in solving many engineering problems, e.g., stress analysis; but it is difficult to apply this thin-slice method directly for the well collision problem. The two small segments (thin slices) of the two near-by wells are constrained by their adjacent well segments. It is difficult to properly assign appropriate boundary conditions so that these two thin-slices may be considered as "free-body" for independent analysis. Consequently, calculating the collision probability of two wells by simply solving the 2-D problem of the thin slice and then summing them together generally will not provide usable results. The foregoing is true even for the case of two straight but non-parallel wells. The more likely case, where two wells are neither straight nor parallel, presents ever greater mathematical challenges. A truly 3-D solution is needed.

SUMMARY OF THE INVENTION

This invention provides a method of drilling a new well to avoid colliding with an existing wellbore. Once a drilling path for a new well has been planned, the method of this invention utilizes available uncertainty information, including without limitation, drilling uncertainty and survey uncertainty, to determine a probability for each of a plurality of segments of the planned drilling path that a projection of the segment onto a plane will intersect a projection of a corresponding segment of the existing wellbore onto the plane; this probability is referred to herein as "gross probability." Then for each segment of the planned drilling path, an area of overlap between the projection onto the plane of the segment and a projection onto the plane of an upper adjacent segment of the planned drilling path is determined (planned segment overlapped area). Similarly, for each corresponding segment of the existing wellbore, an area of overlap between a projection onto the plane of the corresponding segment and a projection onto the plane of an upper adjacent segment of the existing wellbore is determined (existing segment overlapped area). Then a determination is made of the probability that the planned segment overlapped area will intersect the existing segment overlapped area; this probability is referred to herein as "overlapped probability." The method of this invention then determines the probability for each of the plurality of segments of the planned drilling path that the segment will intersect the corresponding segment of the existing wellbore by subtracting the overlapped probability from the gross probability for each segment; this probability is referred to herein as "net probability." The net probability takes into account the constraint that upper adjacent segments of the planned drilling path and existing wellbore impose, respectively, on the segment of the drilling path under investigation and the corresponding segment of the existing wellbore. Finally, the probability that the planned drilling path will intersect the existing wellbore is determined by adding together all of the net probabilities. The drilling path can then be re-planned if the probability of intersection is unacceptable based on standard engineering and economic considerations.

BRIEF DESCRIPTION OF THE DRAWINGS

The present invention and its advantages will be better understood by referring to the following detailed description of the invention and the attached drawings in which.

While the invention will be described in connection with its preferred embodiments, it will be understood that the invention is not limited thereto. On the contrary, the following detailed description is intended to cover all alternatives, modifications, and equivalents which may be included within the spirit and scope of the invention, as defined by the appended claims.

DETAILED DESCRIPTION OF THE INVENTION

Figure 1:
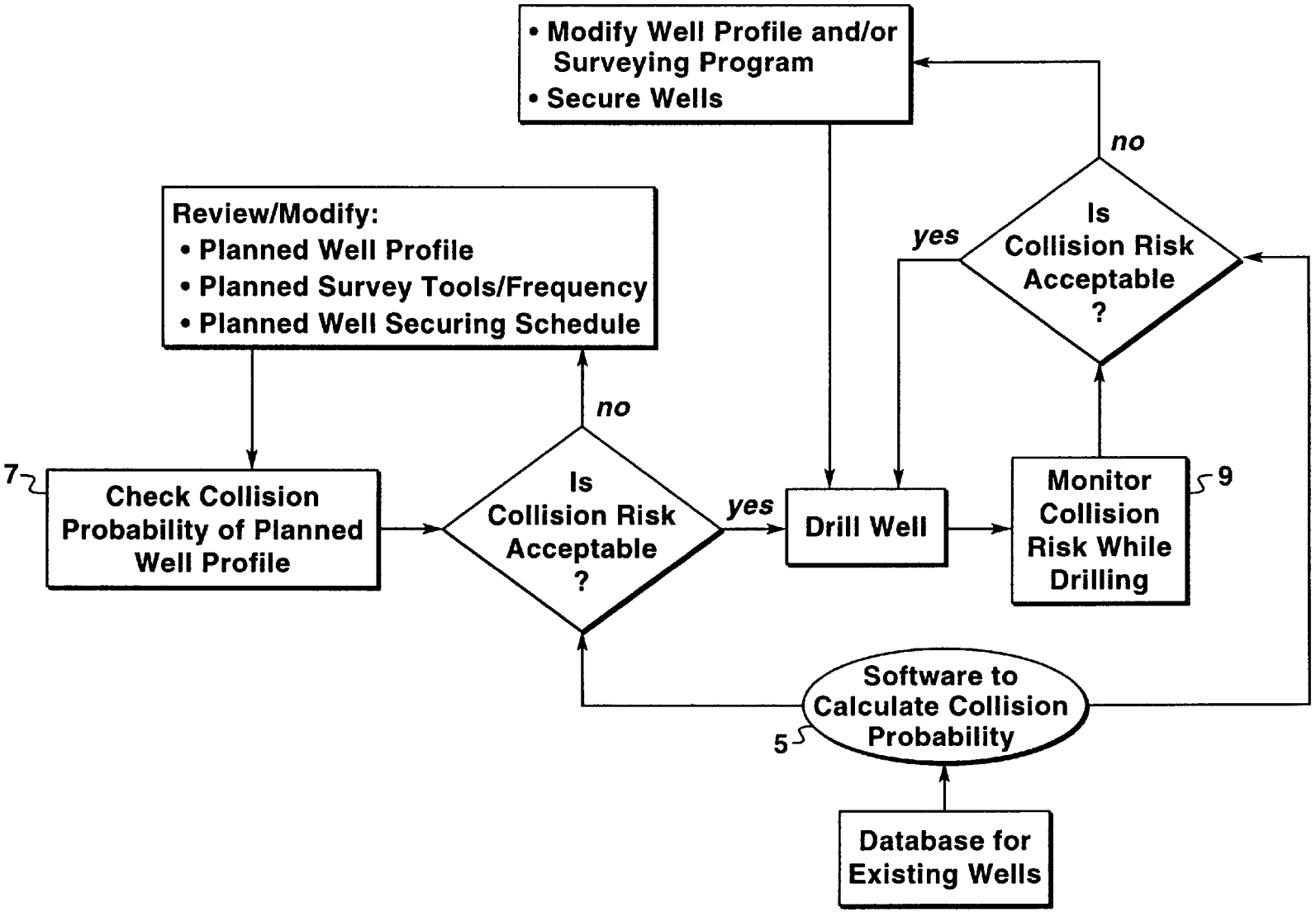
FIG. 1 is a flowchart illustrating the well collision avoidance procedure of this invention.

In somewhat greater detail, this invention provides a method of drilling a new well to avoid colliding with an existing wellbore. The flowchart of FIG. 1 illustrates the well collision avoidance procedure of this invention. An advantage of the invention is that it provides a novel method for determining 3-D well collision probability, as denoted by ellipse 5 of FIG. 1. The method of determining collision probability comprises the steps of: (i) determining a gross probability (PGROSS) for each of 1 through N segments of a planned drilling path that a projection of the segment onto a plane will intersect a projection of a corresponding segment of an existing wellbore onto the plane; (ii) for each of the 1 through N segments of the planned drilling path (a) determining an area of overlap between the projection onto the plane of the segment and a projection onto the plane of an upper adjacent segment of the planned drilling path (planned segment overlapped area), (b) determining for each corresponding segment of the existing wellbore, an area of overlap between a projection onto the plane of the corresponding segment and a projection onto the plane of an upper adjacent segment of the existing wellbore (existing segment overlapped area), and (c) determining an overlapped probability (POVERLAPPED) that the planned segment overlapped area will intersect the existing segment overlapped area; and (iii) calculating a net probability (PNET) for each of the 1 through N segments of the planned drilling path that the segment will intersect the corresponding segment of the existing wellbore equal to (PGROSS-POVERLAPPED); and (iv) calculating the probability that the planned drilling path will intersect the existing wellbore equal to (PNET (1)+PNET (2)+ . . . +PNET(N))

Well known techniques for planning a drilling path, such as "build-and-hold" or "S-turn" methods, and well known techniques for drilling a well along a planned drilling path, such as downhole mud motors or drilling turbines, can be utilized in the method of this invention.

The method of this invention is useful, for example, when drilling a new well in a subterranean formation already populated with wellbores, especially when the choices for spudding locations for the new well are limited to the vicinity of existing wells, such as when drilling from an offshore platform. After engineering criteria and knowledge of the formation have been used to select the spudding location, kick-off point, build rate, and target for the new well, and for planning the initial profile for the new well, the method of this invention can be used to determine whether the initial risk of colliding with any existing wellbore is within acceptable limits to begin to drill the new well according to the initial profile. If the risk is not acceptable, a new profile can be developed for the new well, and then the method of this invention used to assess the risk, etc., in an iterative process until the risk is acceptable. Once the risk is acceptable, the method of this invention can be utilized periodically during drilling to re-assess risk, and a new profile developed for the new well as necessary to avoid colliding with any existing wellbore.

Collision probability determined according to the method of this invention is a function of several parameters including distance and intersection angle between the drilling path and the existing well, survey uncertainty, drilling uncertainty, survey interval, and well diameter. In determining PGROSS and POVERLAPPED, a software program which utilizes the ellipse of uncertainty model standard in the industry can be employed. The 3-D solution of this invention for calculating well collision probability uses the following two innovative techniques: the use of specific projected areas to represent two non-parallel, short segments, and a method that adds constraints and facilitates the integration (summation) of small segments.

Figure 2:
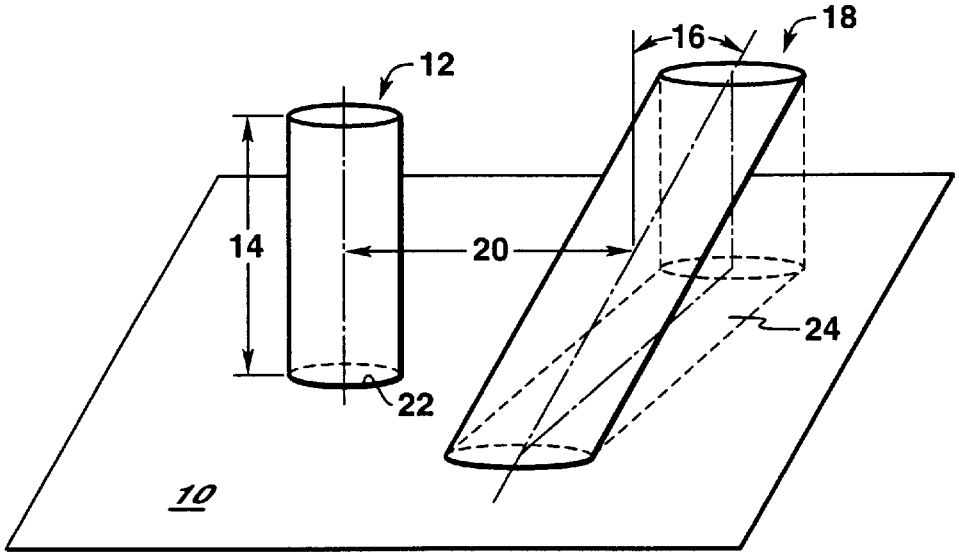
FIG. 2 illustrates a projection of a segment of a planned drilling path onto a plane and a projection of a corresponding segment of an existing wellbore onto the same plane.

The use of specific projected areas to represent two non-parallel, short segments:

The method of this invention approximates the collision probability of two non-parallel, short segments, one from a planned drilling path (or new well), another from an existing wellbore, by determining the probability of collision of projections of these two segments onto a plane, represented on the plane as projected areas. This concept is illustrated in FIG. 2, where a projection plane 10 perpendicular to a segment of the new well 12 is selected for convenience. The length 14 of the new well segment 12 is H, the intersection angle 16 between the new well segment 12 and a corresponding segment of the existing wellbore 18 is θ, and the distance 20 between the two wells is D. The usefulness of these parameters in the method of this invention is discussed in greater detail later. The projected area 22 of the new well onto plane 10 is a circle and the projected area 24 of the existing well 18 onto plane 10 is a rectangle plus a half ellipse at each end. The collision probability of these two segments 12 and 18 is equal to the 2-D collision probability of the two projected areas 22 and 24 in the plane 10. If the two well segments 12 and 18 were to overlap or collide, then the projected areas 22 and 24 would likewise overlap or collide. The 2-D collision probability calculated here is referred to as gross collision probability because it does not include the effect of any constraints imposed on these two well segments by adjacent segments.

Figure 3:
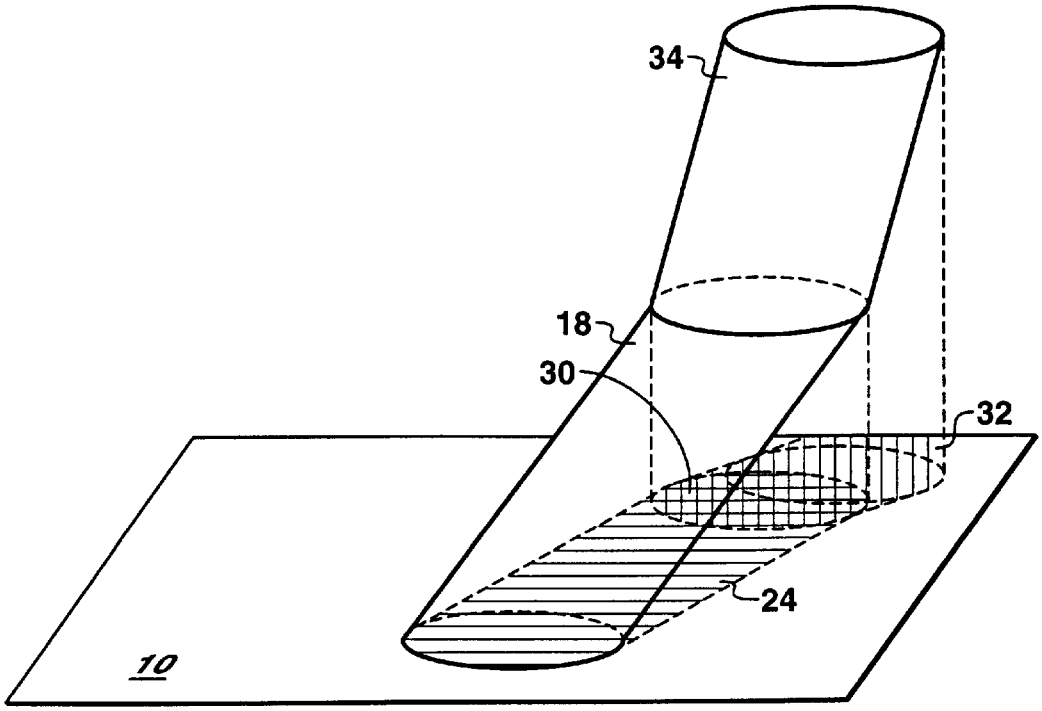
FIG. 3 illustrates an area of overlap on the plane of FIG. 2 of the projection of the segment of the existing wellbore of FIG. 2 with a projection of an upper adjacent segment of the existing wellbore.

A method that adds constraints and facilitates the integration (summation) of small segments:

The method of this invention takes into account the constraint imposed by the well segment adjacent to the segment under investigation. This constraint may be represented by a projected area on the plane 10 of FIG. 2. This projected area (representing constraint) is the overlap between the projected areas of the current segment and of the well segment above it. The "net" collision probability of a segment, or the collision probability that can be used for 3-D integration, is the collision probability calculated from an area that represents the projected area of that segment subtracting the overlapped projected area occupied by the well segment above that segment. This concept is illustrated in FIG. 3, which shows an area of overlap 30 on plane 10 of the projected area 24 of the segment of the existing wellbore 18 with a projection 32 of an upper adjacent segment 34 of the existing wellbore 18. The overlapped area 30, shown by crosshatched lines, is the area of excess probability, which needs to be subtracted from the gross collision probability of the segment. The probability after subtraction is referred to as net probability because the effect of constraint is considered. The foregoing concept is likewise applied to the segment of the new well under investigation.

Using the above two techniques, the collision probability for drilling a portion of the new well may be calculated by the following steps:

1. Divide that portion of the well, and the corresponding portion of the existing wellbore, into small segments. Based on standard engineering considerations, the length of each segment should be small enough to provide a good approximation but not too small to make calculations cumbersome. The desirable range for the length of these segment may vary between 0.1 feet (0.03 meters) to 100 feet (30 meters).
2. Calculate the gross collision probability of each segment, according to the method described herein. This calculation assumes that each segment is independent (without constraints) and properties are constants within a segment.
3. Calculate the overlapped probability. The overlapped probability is the portion of gross collision probability that has to be subtracted because segments are not independent. Each segment is constrained by the segments above.
4. Subtract overlapped probability from gross collision probability for each segment to get its net collision probability. Total collision probability may then be obtained by adding all net collision probabilities together since the total collision probability is small (i.e., less than $10^{-2}$) for all practical cases. In strict theory, the collision of each segment is not an independent event. The total probability should be P1+(1−P1)*P2+[1−P1−(1−P1)*P2]*P3+ . . . , where P1, P2 . . . are the collision probabilities of consecutive segments. However, since P1, P2 . . . are very small numbers, the use of summation is accurate enough for all practical purposes.

For a given operation, a threshold collision probability may be determined, using known industry techniques, from acceptable risk and from the probability that a collision will lead to a problem. If the calculated collision probability is near or above this threshold probability, preventative actions may be taken to reduce risk. Collision probability calculated from the above procedure is a function of several parameters—distance between the two wells, survey uncertainty, drilling uncertainty, survey interval, well diameter, and intersection angle between the two wells. Some of these parameters may be adjustable to lower the collision probability for lower risk. These parameters may include well distance, survey uncertainty, survey interval and intersection angle. Risk may also be reduced by lowering the probability from collision to problem.

An overall well collision avoidance procedure may be implemented for planning and drilling wells. This procedure may systematically reduce the risk and cost associated with well collision problems.

As discussed above, the 3-D collision problem of two well segments may be reduced to a 2-D problem by using the technique of projected areas. Since the well segments are short, they may be assumed to be two straight cylinders. The 2-D problem may be represented by FIG. 4, where a 2-D plane perpendicular to the axis of the new well is selected as the projection plane. The center 40 of the new well projection 41 is located at x=0, y=0, and the center 42 of the existing well projection 43 is located at x=D(44), y=S/2(47), where D is the shortest center-to-center distance 44 between the two well segments 41 and 43 and S is the length 46 of the rectangle. The projected area 41 of the new well is a circle with a radius R1. The projected area 43 of the existing well is a rectangle plus a half ellipse at each end. The length 46 of the rectangle is S and its width is 2*R2, where R2 is the radius of the existing well. The two semi-axes of the ellipse are R2 and R2/cos (θ), where θ is the intersection angle.

Figure 4:
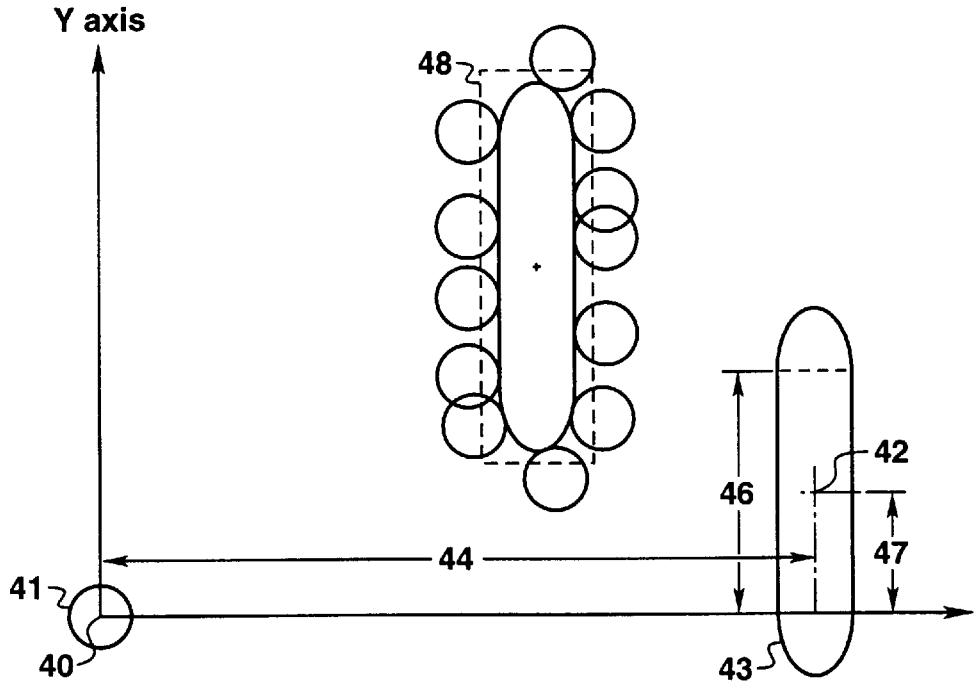
FIG. 4 illustrates an XY plot of the projected well segments of FIG. 2, utilizing the assumption that the projected well segments are two straight cylinders.

Because the locations of the two well segments 41 and 43 are not certain, their centers 40 and 42 may be represented by probability functions. The positions of the two centers 40 and 42, (0,0) and (D, S/2), shown in FIG. 4, are the most likely positions.

The probability functions of the two centers 40 and 42 are designated as F1(x,y) for the new well projection 41 and F2(x,y) for the existing well projection 43. The probability that the center 40 of the new well projection 41 is located at a given point (x,y) is F1(x,y) *dx*dy, where dx*dy represents an infinitesimal rectangle. If both distribution functions are assumed to be normal functions, for the new well projection 41, F1(x,y) may be expressed as:

$$F1(x,y)=[1/(2\pi\sigma^2)]*e^{-(x*x)/(2\sigma*\sigma)}*e^{-(y*y)/(2\sigma*\sigma)}=f1(x)*f1(y)$$

where e is the exponential function

σ is the location uncertainty or standard deviation (assumed to be the same in x and y directions)

$f1(x)=\{1/[(2\pi)^{1/2}\sigma]\}*e^{-(x*x)/(2\sigma*\sigma)}$ $f1(y)=\{1/[(2\pi)^{1/2}\sigma]\}*e^{-(y*y)/(2\sigma*\sigma)}$ The probability function F1(x,y) may be represented by the product of functions f1(x) and f1(y). Similarly, the probability function F2(x,y) may also be represented by the product of f2(x) and f2(y).

The objective is to determine the collision probability of the two projected areas 41 and 43. The basic approach is to find the infinitesimal collision probability at a given point in the x-y plane and then to integrate over the entire x-y plane. As shown in FIG. 4, the two wells will collide if they contact or overlap each other. If the center 42 of the existing well 43 is located at point (x,y), the two wells will collide if the center 40 of the new well 41 is located within a distance R1 from the boundary of the existing well, where R1 is the radius of the new well. This area within which collision will occur is a rectangle with a half ellipse at each end. The length of this rectangle is S and the width is 2*(R1+R2). The two semi-axes of the ellipse are (R1+R2) and [R1+R2/cos (θ)]. To simplify the mathematics without losing much accuracy, this area can be substituted with a rectangle. The width of this rectangle is slightly smaller at $\pi^{1/2}*(R1+R2)$ and the length is:

$$L=S+\pi^{1/2}*[R1+R2/\cos(\theta)]$$

The boundary of this rectangle is represented by the dotted line 48 in FIG. 4. Collision occurs when the center of the new well is located within this rectangle. The collision probability at point (x,y) may now be represented by:

$$\text{Collision Probability at point}(x, y) = dx * dy * F2(x, y) * \int_{y-(L/2)}^{y+(L/2)} dv \int_{x-\pi^{1/2}*(RI+R2)}^{x+\pi^{1/2}*(RI+R2)} [F1(u, v)\,du]$$

This equation may be separated into functions of x and y as:

$$= \left\{[f2(y)dy] * \int_{y-(L/2)}^{y+(L/2)} [f1(v) * dv]\right\} * \left\{[f2(x)dx] @ * \int_{x+\pi^{1/2}*(RI+R2)}^{x+\pi^{1/2}*(RI+R2)} [f1(u) * du]\right\}$$

The gross collision probability between the two well segments may be obtained by integrating over the entire x-y plane, from minus infinity to plus infinity. Using calculus and numerical integration, the approximate equation for the gross collision probability of a segment may be written as:

$$P_S=\{P_{11}*W(Rx)+P_{21}[*1-W(Rx)]\}*\{P_{12}*W(Ry)+P_{22}*[1-W(Ry)]\}$$

where $P_{11}=0.5*\{1+\mathrm{Erf}[(0.5*\pi^{1/2}*(R1+R2)-D)/(2^{1/2}*\sigma)]\}$ $P_{12}=0.5*\{1+\mathrm{Erf}[0.5*\pi^{1/2}*(R1+R2/\cos(\theta))/(2^{1/2}*\sigma)]\}$ $P_{21}=[(R1+R2)/(2^{1/2}*\sigma)]*e^{[-D*D/(2*\sigma*\sigma)]}$ $P_{22}=\{[S+\pi^{1/2}*(R1+R2/\cos(\theta))]/[(2\pi)^{1/2}*\sigma)]\}*e^{[-S*S/(8*\sigma*\sigma)]}$ S=H*tan(θ), projected length of existing well segment H=length of a segment cos, tan=cosine and tangent of an angle W is a function defined as:

| | | |
|---|---|---|
| $W(x)$ | $= 1$ | for $x \geq 0.55$ |
| □ | $= 4 * (x - 0.05)^2$ | for $0.05 < x < 0.55$ |
| □ | $= 0$ | for $x \leq 0.05$ |

$Rx=[(\pi^{1/2}/2)*(R1+R2)]/\sigma$ $Ry=\{0.5*S+(\pi^{1/2}/2)*[R1+R2/\cos(\theta)]\}/\sigma$ Erf is the error function that can be found in most mathematical reference books.

After deriving the equations for calculating the gross collision probability between two segments, the next step is to calculate collision probability of the overlapped area. Referring again to FIG. 3, the overlapped area is represented by the cross-lined area 30. For the overlapped collision probability, equations similar to the ones used for the gross collision probability can also be derived:

$$P_0=\{P_{11}*W(Rxo)+P_{21}*[1-W(Rxo)]\}*\{P_{12}*W(Ryo)+P_{22}*[1-W(Ryo)]\}$$

where $P_{11}=0.5*\{1+\mathrm{Erf}[0.5*\pi^{1/2}*(R1+R2)-D_0)/(2^{1/2}*\sigma_0)]\}$ $P_{12}=0.5*\{1+\mathrm{Erf}[0.5*\pi^{1/2}*(R1+R2/\cos(\theta_0))/(2^{1/2}*\sigma_0)]\}$ $P_{21}=[(R1+R2)/(2^{1/2}*\sigma_0)]\,e^{[-D}0*^{D}0/(2*\sigma_0*\sigma_0)]$ $P_{22}=\{[R1+R2/\cos(\theta_0)]/[2^{1/2}*\sigma_0]\}$ $Rxo=[(\pi^{1/2}/2)*(R1+R2)]/\sigma_0$ $Ryo=\{(\pi^{1/2}/2)*[R1+R2/\cos(\theta_0)]\}/\theta_0$ The subscript "0" represents values for the overlapped area that are different from the ones used for calculating gross collision probability The net collision probability of each segment, P, may now be calculated as:

$$P_n=P_S-P_0$$

Figure 5:
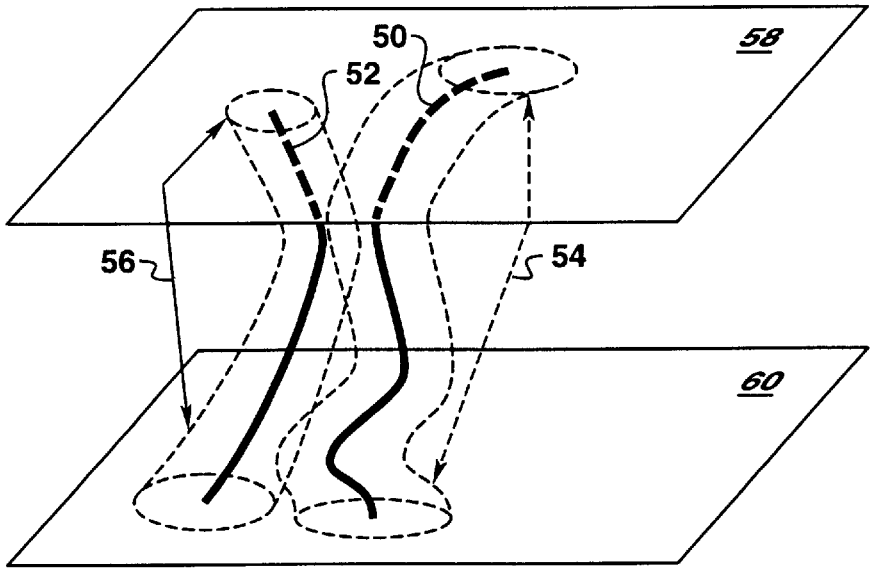
FIG. 5 is a schematic illustrating two close wells and their associated location uncertainties.

Referring to FIG. 5, the total collision probability will be the summation of the probabilities of all segments between planes 58 and 60.

In calculating collision probability, the distance between planes 58 and 60 in FIG. 5 (length of wellpath) can be estimated as the distance from current bit location to the end of the well (i.e., total depth) or to the next survey point. It is preferable to use a fixed length of new hole to be drilled, instead of the rest of the well, to account for the effects of new surveys that reduce drilling uncertainty. At each survey point, drilling uncertainty returns to zero. Using a fixed length also allows a common ground for comparison among different points of a well and among different wells. This fixed distance may be referred to as the "probability interval", which is based on projecting down the expected well path from a present or future bit position.

The collision probability does not have to be calculated at exactly the same distance as the probability interval. It is preferable to calculate probability values all along the proposed well path to anticipate the situation expected during drilling, i. e., the probability of contact in the next probability interval beyond x once the bit reaches depth "x". The places where collision probability is calculated are referred to as "display points" and the distance between subsequent display points is referred to as "display interval". The probability intervals for subsequent display intervals will overlap, but each individual collision probability will be correct.

To localize trouble spots, it is useful to calculate collision probability at short distances, for example, about every 10 feet (3 meters) to 30 feet (9 meters) along a proposed path. Use of much longer distance, such as greater than about 300 feet (90 meters), could lead to excessive use of preventive measures (i.e., actions start earlier than needed). The interval needs to be long enough to include most of the collision probability in a given well collision situation. The whole QRA approach requires that the criterion for preventative actions be based on the total probability of contact as two wells pass by each other. Use of intervals which are too short could result in difficulty accounting for the effects of several adjacent (not overlapping) intervals with significant probability. These independent probabilities could be added to get the total collision probability, but it is preferable to have a single number calculated for direct comparison with the threshold probability. A desirable probability interval is around 100 feet (30 meters), which is a compromise between these two competing needs.

Sample calculation steps may be summarized as:

1. Provide input data for four array variables (i.e., calculated or measured values) of each well segments (e.g., about every 3 feet (1.3 meters)). These four array variables are:
   (a) measured depth of the new well;
   (b) combined survey uncertainty of the new and existing wells;
   (c) closest center-to-center distance between the two wells; and
   (d) angles between these two wells.
2. Provide input data for seven constant variables for each well segment:
   (a) radius (radii) of the new well;
   (b) radius (radii) of the existing well;
   (c) the angle(s) for drilling uncertainty;
   (d) the length(s) of each segment;
   (e) probability interval(s);
   (f) display interval(s); and
   (g) scan interval(s).

As discussed earlier, probability interval is the interval from current measured depth over which collision probability calculations will be made and display interval is the distance between two adjacent display points. Scan interval is the interval from current measured depth of the new well over which collision probability calculation will be made.

Figure 6:
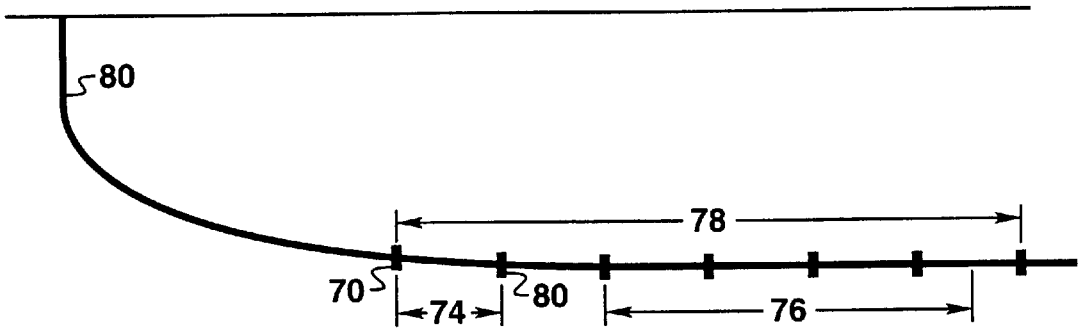
FIG. 6 is a schematic drawing illustrating probability intervals, display intervals, and scan intervals as are further explained in the following detailed description of the invention.

FIG. 6 illustrates the relationship between display points, e.g., 70 and 72, display interval 74, probability interval 76, and scan interval 78 of a new well 80. As illustrated by FIG. 6, a scan interval, such as scan interval 78, can cover many display points.

3. Determine the number of segments needed for subsequent calculations. These numbers are used to control the number of iterations needed for probability calculations.
4. Start calculations at a display point. For each display point, the collision probability is calculated for the next x feet of the new well that will be drilled from that display point, where x is equal to the length of the probability interval. Its collision probability is calculated by adding the individual probabilities of all segments that belong to that to-be-drilled x-feet. This approach is similar to numerical integration. In this case, integration along the axial direction of the new well from a specific display point down to x feet ahead of that display point is utilized.
5. Calculate angle, total uncertainty and center-to-center well distance for each segment associated with that display point. Values for the upper and lower node points of a segment are calculated first. The total uncertainty of a node point is the square root of the sum of squares of the combined survey uncertainty and the drilling uncertainty. With the exception of well distance, the input values used for each segment are the averages of the values of the two node points above and below that segment. The well distance for a segment is the shorter of the two well distances of the two connecting node points.
6. Calculate the gross collision probability of each segment. The gross collision probability represents the probability of a new well segment that stands alone and that is not affected by the well connected from above. The actual collision probability is smaller than the gross collision probability because the connected well (already drilled) adds constraints and consequently, reduces the chance of collision.
7. Calculate the overlapped probability for each segment. The overlapped probability represents the probability contributed by the portions of the well connected above the current segment. Data for the upper node point are used for this calculation.
8. Subtract the overlapped probability from the gross probability of each segment. This is the true collision probability for that segment.
9. The collision probability for a given display point is the summation of the probability of all segments within the probability interval ahead of that display point.
10. Repeat Steps 5–9 for each display point of the whole scan interval.

The calculated collision probability may be used as a part of the procedure for collision avoidance, which may be represented by the flow diagram shown in FIG. 1. In this procedure, collision probability is used in both planning (box 7) and monitoring (box 9) of a well. In both situations, a question "is collision risk acceptable?" is asked. If the answer is "yes", the process will continue. If the answer is "no", some corrective actions may be taken and the collision risk will be evaluated again. This process is iterated until the collision risk is reduced to an acceptable level. As represented by ellipse 5 in FIG. 1, the probability calculation plays a key role in answering this question.

Collision risk may be reduced in several ways. It may be reduced by changing well profile, which could increase the distance between the new well and the existing well(s). A better survey tool may be used and survey may be conducted more frequently. Consequences of collision be reduced by "securing" the existing wells. An existing well is secured if some preventive actions have been implemented to reduce consequences of collision. Wells may be secured by known methods such as plugging, shutting-in, or lowering fluid pressure.

EXAMPLE 1

A well collision avoidance procedure was implemented as a part of a platform drilling program. The maximum acceptable blowout frequency due to well collision was established as $1*10_{-5}$ per year and the probability from well collision to blowout was estimated to be less than 0.024. Since:

$$\text{(Collision probability)*(Probability from collision to blowout)<(Acceptable risk)}$$

the maximum acceptable collision probability may be calculated as:

(Collision probability)<$(1*10^{-5})/(0.024)$ per year, or $2*10_{-3}$ per year

Based on 10 wells drilled each year for that platform and a conservative average of two close encounters for each well drilled, there would be about 20 potential collision cases per year. The threshold collision probability for each incident of close encounter was then calculated as:

$(2*10_{-3}$ per year)/(20 per year)=$1*10^{-4}$ per incident

A collision avoidance procedure following the steps shown in FIG. 1 was established by using $1*10_{-4}$ as the threshold probability for well collision.

Figure 7:
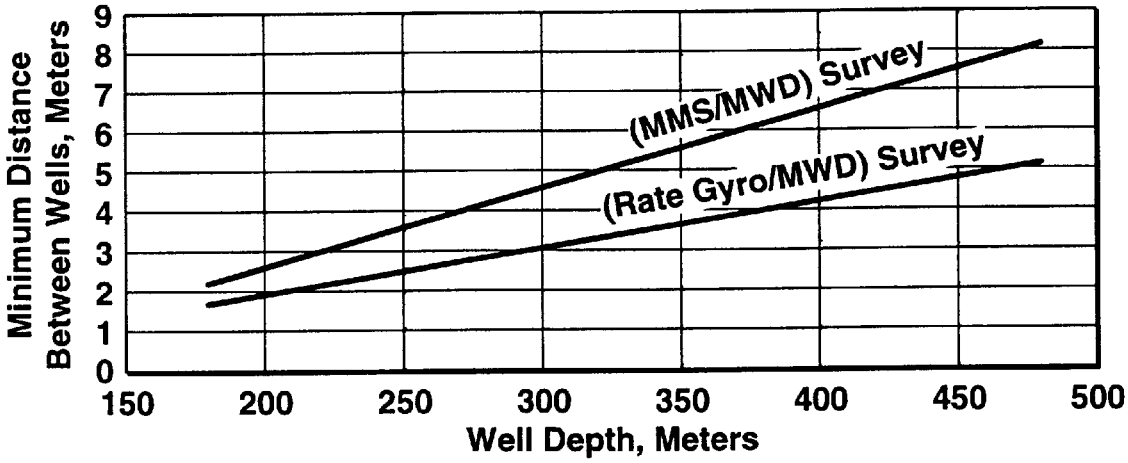
FIG. 7 is a plot of minimum distance between wells vs. well depth for two different sets of survey tools.

Results of an example calculation for this procedure are graphically illustrated in FIG. 7. The following input parameters were used:

| | |
|---|---|
| Drilling uncertainty: | 0.5 degrees |
| Probability interval: | 98 feet (30 meters) |
| Existing Well diameter: | 17.5 inches (50 mm) |
| New Well diameter: | 17.5 inches (50 mm) |
| Intersection angle: | 3 degrees |
| Length of each segment: | 3.3 feet (1 meter) |

In FIG. 7, minimum distance between two wells are plotted against well depth for using two different sets of survey tools. This minimum distance is the threshold distance, where a shorter distance would results in a collision probability higher than $10^{-4}$ and a blowout risk higher than the established acceptable level. The two sets of survey tools represent combinations of three different survey tools, Magnetic Multi-Shots ("MMS"), Measurement While Drilling ("MWD"), and Rate Gyro. The (Rate Gyro/MWD) combination has a survey uncertainty of 3.4 parts per thousand (i.e., 3.4 feet error per 1,000 feet depth), which is significantly better than the (MMS/MWD) combination with a uncertainty of 5.8 parts per thousand. A better survey tool reduces uncertainty and results in lower collision probability.

EXAMPLE 2

In this example, fifty-one sets of hypothetical data are provided. Each set includes measured depth, combined survey uncertainty, well distance, and angle between two wells. These data are listed in the following table:

TABLE 1

| Measured Depth (Meters) | Survey Uncertainty (Meters) | Well Distance (Meters) | Angle Between wells (degrees) |
|---|---|---|---|
| 300 | 0.62 | 6.85 | 5 |
| 301 | 0.6212 | 6.725 | 5 |
| 302 | 0.6224 | 6.6 | 5 |
| 303 | 0.6236 | 6.475 | 5 |
| 304 | 0.6248 | 6.35 | 5 |
| 305 | 0.626 | 6.3 | 5 |
| 306 | 0.6272 | 6.25 | 4.9 |
| 307 | 0.6284 | 6.2 | 4.8 |
| 308 | 0.6296 | 6.15 | 4.7 |
| 309 | 0.6308 | 6.1 | 4.6 |
| 310 | 0.632 | 6.05 | 4.5 |
| 311 | 0.6332 | 5.97 | 4.4 |
| 312 | 0.6344 | 5.89 | 4.3 |
| 313 | 0.6356 | 5.81 | 4.2 |
| 314 | 0.6368 | 5.73 | 4.1 |
| 315 | 0.638 | 5.65 | 4 |
| 316 | 0.6392 | 5.57 | 4 |

TABLE 1-continued

| Measured Depth (Meters) | Survey Uncertainty (Meters) | Well Distance (Meters) | Angle Between wells (degrees) |
|---|---|---|---|
| 317 | 0.6404 | 5.45 | 4.2 |
| 318 | 0.6416 | 5.33 | 4.4 |
| 319 | 0.6428 | 5.21 | 4.6 |
| 320 | 0.644 | 5.09 | 4.8 |
| 321 | 0.6452 | 4.97 | 5 |
| 322 | 0.6464 | 4.85 | 5.2 |
| 323 | 0.6476 | 4.73 | 5.4 |
| 324 | 0.6488 | 4.61 | 5.6 |
| 325 | 0.65 | 4.49 | 5.8 |
| 326 | 0.6512 | 4.37 | 6 |
| 327 | 0.6524 | 4.25 | 6.2 |
| 328 | 0.6536 | 4.13 | 6.4 |
| 329 | 0.6548 | 4.O1 | 6.6 |
| 330 | 0.656 | 3.89 | 6.8 |
| 331 | 0.6572 | 3.77 | 7 |
| 332 | 0.6584 | 3.65 | 7.2 |
| 333 | 0.6596 | 3.53 | 7.4 |
| 334 | 0.6608 | 3.41 | 7.6 |
| 335 | 0.662 | 3.29 | 7.8 |
| 336 | 0.6632 | 3.17 | 8 |
| 337 | 0.6644 | 3 | 8.2 |
| 338 | 0.6656 | 3.12 | 8.4 |
| 339 | 0.6668 | 3.24 | 8.6 |
| 340 | 0.668 | 3.36 | 8.8 |
| 341 | 0.6692 | 3.48 | 9 |
| 342 | 0.6704 | 3.6 | 9.2 |
| 343 | 0.6716 | 3.78 | 9.4 |
| 344 | 0.6728 | 3.96 | 9.6 |
| 345 | 0.674 | 4.14 | 9.8 |
| 346 | 0.6752 | 4.32 | 10 |
| 347 | 0.6764 | 4.5 | 10.2 |
| 348 | 0.6776 | 4.68 | 10.4 |
| 349 | 0.6788 | 4.86 | 10.6 |
| 350 | 0.68 | 5.04 | 10.8 |

Using the above data, a 30-meter (98-foot) probability interval, a 20-meter (66-foot) scan interval, and a 5-meter (6-foot) display increment, with 17.5-inch diameter for both wells, yields the collision probability values shown in Table 2 below.

TABLE 2

| Measure Depth (Meters) | Collision Probability |
|---|---|
| 300 | 9.5177E − 14 |
| 305 | 9.2808E − 11 |
| 310 | 3.1564E − 8 |
| 315 | 3.9712E − 6 |
| 320 | 2.8602E − 5 |

Significant savings can be realized by implementing this collision avoidance technology. A computer program may be used to implement many steps of the method described herein.

Many modifications and variations besides those specifically mentioned may be made in the techniques and methods mentioned herein without departing substantially from the concept of the present invention. It is expected that good engineering practice will be utilized in practicing the method of the present invention. Accordingly, it should be understood that the forms of the invention described and illustrated herein are intended as examples, and are not intended as limitations on the scope of the present invention.

We claim:

1. A method of drilling a new well to avoid colliding with an existing wellbore, said method comprising the steps:

(a) planning a drilling path for said new well;

(b) for each of 1 through N segments of said drilling path, determining a gross probability (PGROSS) that a projection of said segment onto a plane will intersect a projection of a corresponding segment of said existing wellbore onto said plane;

(c) for each of said 1 through N segments of said planned drilling path, (i) determining an area of overlap between said projection onto said plane of said segment and a projection onto said plane of an upper adjacent segment of said planned drilling path (planned segment overlapped area), (ii) determining for each corresponding segment of said existing wellbore, an area of overlap between a projection onto said plane of said corresponding segment and a projection onto said plane of an upper adjacent segment of said existing wellbore (existing segment overlapped area), and (iii) determining an overlapped probability (POVERLAPPED) that said planned segment overlapped area will intersect said existing segment overlapped area; and (d) for each of said I through N segments of said planned drilling path, calculating a net probability (PNET) that said segment will intersect said corresponding segment of said existing wellbore equal to (PGROSS−POVERLAPPED); and (e) calculating a probability that said drilling path will intersect said existing wellbore equal to (PNET (1)+PNET (2)+ . . . +PNET(N));

(f) if said probability indicates that said drilling path will intersect said existing wellbore, re-planning said drilling path and return to step (b); and (g) drilling said new well along said drilling path.

2. The method of claim 1 in which a computer program is used to implement steps (a) through (f).

3. The method of claim 2 in which input parameters for said computer program comprise distance between said drilling path and said existing wellbore, survey uncertainty, drilling uncertainty, survey interval, well diameter, and intersection angle.

4. A method of determining a probability that a planned drilling path will intersect an existing wellbore, said method comprising the steps:

(a) for each of 1 through N segments of said planned drilling path, determining a gross probability (PGROSS) that a projection of said segment onto a plane will intersect a projection of a corresponding segment of said existing wellbore onto said plane;

(b) for each of said 1 through N segments of said planned drilling path, (i) determining an area of overlap between said projection onto said plane of said segment and a projection onto said plane of an upper adjacent segment of said planned drilling path (planned segment overlapped area), (ii) determining for each corresponding segment of said existing wellbore, an area of overlap between a projection onto said plane of said corresponding segment and a projection onto said plane of an upper adjacent segment of said existing wellbore (existing segment overlapped area), and (iii) determining an overlapped probability (POVERLAPPED) that said planned segment overlapped area will intersect said existing segment overlapped area; and (c) for each of said 1 through N segments of said planned drilling path, calculating a net probability (PNET) that said segment will intersect said corresponding segment of said existing wellbore equal to (PGROSS−POVERLAPPED); and (d) calculating said probability that said planned drilling path will intersect said existing wellbore equal to (PNET (1)+PNET (2)+ . . . +PNET(N)).

* * * * *